US006857472B2

(12) United States Patent
Stave

(10) Patent No.: US 6,857,472 B2
(45) Date of Patent: Feb. 22, 2005

(54) WELL PUMP DEVICE

(75) Inventor: Roger Stave, Knarrevik (NO)

(73) Assignee: ADR Subsea AS, Straume (NO)

( * ) Notice: Subject to any disclaimer, the term of this patent is extended or adjusted under 35 U.S.C. 154(b) by 0 days.

(21) Appl. No.: 10/258,595

(22) PCT Filed: Apr. 27, 2001

(86) PCT No.: PCT/NO01/00177

§ 371 (c)(1),
(2), (4) Date: Jan. 3, 2003

(87) PCT Pub. No.: WO01/83941

PCT Pub. Date: Nov. 8, 2001

(65) Prior Publication Data

US 2004/0007353 A1 Jan. 15, 2004

(30) Foreign Application Priority Data

May 3, 2000 (NO) ..... 20002335

(51) Int. Cl.[7] ..... E21B 43/00

(52) U.S. Cl. ..... 166/106; 166/68.5; 166/101; 166/105; 166/107; 166/135

(58) Field of Search ..... 166/68, 68.5, 106, 166/105, 107, 101, 135

(56) References Cited

U.S. PATENT DOCUMENTS

| | | | | |
|---|---|---|---|---|
| 3,225,697 A | * | 12/1965 | Brown | 417/20 |
| 3,891,031 A | | 6/1975 | Ortiz | |
| 3,974,878 A | | 8/1976 | Roeder et al. | |
| 4,693,271 A | * | 9/1987 | Hargrove et al. | 137/565.17 |
| 4,928,771 A | | 5/1990 | Vandevier | |
| 5,297,943 A | * | 3/1994 | Martin | 417/422 |

* cited by examiner

*Primary Examiner*—David Bagnell
*Assistant Examiner*—Giovanna Collins
(74) *Attorney, Agent, or Firm*—Foley & Lardner LLP

(57) ABSTRACT

A well pump device, especially for use in connection with the recovery of hydrocarbons, wherein the pump is carried to a predetermined position within a well pipe. The pump is provided with an external seal which is arranged to prevent fluid from flowing from the pressure side of the pump past the pump to the suction side thereof.

21 Claims, 1 Drawing Sheet

WELL PUMP DEVICE

BACKGROUND OF THE INVENTION

This invention relates to a well pump in particular for use in a well in connection with the recovery of hydrocarbons.

SUMMARY OF THE INVENTION

In recent years the development in the drilling technology for the recovery of petroleum has steadily moved in the direction of more deviation drilling, which means that from a drilling station wells can be drilled to petroleum deposits located at a considerable horizontal distance from the drilling station.

Such drilling involves that the pipe angle in the well strongly deviates from the vertical direction. In some cases the well may be approximately horizontal.

It is often necessary to place a pump in the well in order to increase the pressure or pump fluid up. Conventionally, the pumps have been positioned by being lowered into the well by means of gravity in order then to be pulled back up by means of a line or similar attached to the pump. The pump delivers the fluid through a connected pressure pipe or hose. In wells that have a large angular deviation relative to the vertical axis, the pump must be pushed forward to its predetermined position in the well. This may be accomplished by the use of a so-called drive plug. The drive plug is a device adapted for transporting equipment internally in pipes. It may be provided with seals that seal against the inner wall of the pipe, and is, in that case, pushed back and forth within the pipe by means of the pressure difference in the pipe. Another type of drive plug is provided with driven wheels or belts, which carry the plug in the desired direction through contact with the pipe wall.

Drive plugs based on propulsion by means of differential pressure normally have the greatest pull-thrust-force, and are therefore often used when relatively large loads are to be transported.

The use of such plugs, which must be pulled out of the well after the pump has been installed, represents a great risk of damage to the power and instrument cable of the well pump. To position an often long pressure pipe from the pump up to the surface is expensive and labour-intensive.

The object of the invention is to remedy the drawbacks of known techniques/devices that make use of a drive plug and a separate pressure pipe/hose.

The object is realized according to the invention through the features specified in the description below.

An electrically or hydraulically operated pump of a kind known in itself, comprising a motor, a suction screen/inlet, a pump housing, one or more pump stages, outlet and connected cables or pipes/hoses for the supply of energy and control, is provided with an external seal which seals against the internal wall of the pipe. The pump is provided with centralizing devices, which keep the pump centred in the pipe. The pump may further be provided with a valve/blocking device which may shut off the flow of fluid through the pump.

When the pump is to be used, it is inserted into the well pipe in the same way as a differential pressure drive plug. Because the passage through the pump is closed and the external seal is sealing against the wall of the well pipe, fluid cannot get past the pump.

The position of the pump in the well can be determined by, for example, previously mounted stops or a seat in the well pipe, or in that the pump is retained by a line or reinforced cable/hose attached to the pump.

After the passage has been opened and the pump started, the pump delivers fluid from one side of the pump to the other side, thus using the well pipe as a pressure pipe. The external seal against the wall of the well pipe prevents the fluid from returning past the pump.

A development of the pump may be to adapt it for use in tanks and other containers to which access is difficult, but where there are premounted access pipes or similar.

BRIEF DESCRIPTION OF THE DRAWINGS

In the following a non-limiting example of a preferred embodiment is described, and it is visualized in the accompanying drawings, in which.

DETAILED DESCRIPTION OF THE PREFERRED EMBODIMENTS

Figure 1:
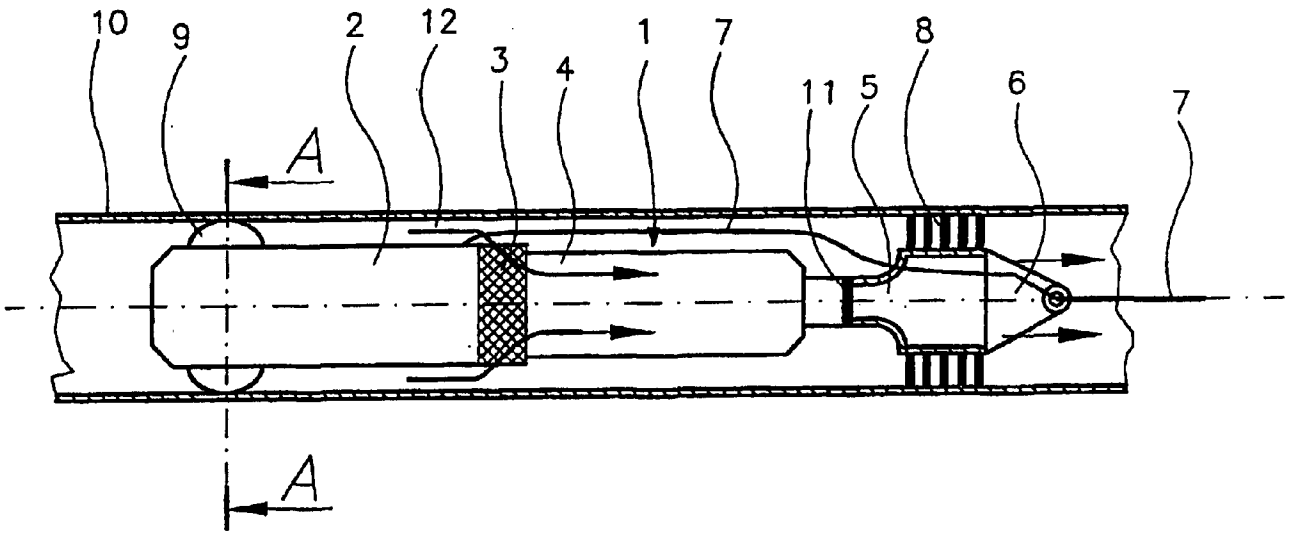
FIG. 1 shows, partly in section, the pump mounted in a well pipe.
Figure 2:
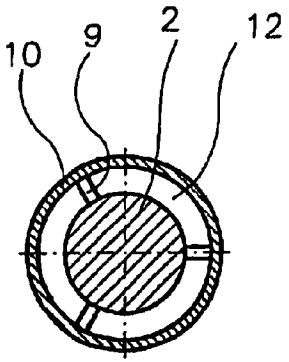
FIG. 2 shows a section through the pump and the well pipe at the centralizing devices.

In FIG. 1 the reference numeral 1 identifies an electrically or hydraulically driven pump comprising a motor 2, a suction screen/inlet 3, a pump housing 4, which may be provided with one or more pump stages not shown, an outlet 5 and an attachment bearing 6 for connected cables or pipes/hoses 7 for the supply of energy and control of the pump. The pump 1 is provided with an external seal 8, which seals against the internal wall surface of a well pipe 10, and a centralizing device 9, which keeps the pump centred within the pipe. The centralizing device may comprise three or more resilient bows secured to the motor housing 2 and arranged to press resiliently against the internal wall of the pipe 10. The pump 1 may further be provided with a valve 11 or a blocking device of a kind known in the art, which may shut off the flow of fluid through the pump 1.

When the pump 1 is to be used, it is inserted into the well pipe 10. The internal valve 11 is closed, thereby sealing against fluid passage through the pump housing 4. The external seal 8 seals against the internal surface of the well pipe 10. The pump 1 thus seals against the well pipe 10 in the same way as a drive plug and may be carried forward to the desired position in the well by means of differential pressure within the pipe.

The position of the pump 1 in the well pipe 10 may be predetermined, for example by a previously installed (not shown) stop in the well pipe 10, or in that the pump 1 is retained by a line or reinforced cable/hose 7 attached to the pump 1 in the attachment bearing 6.

Energy is supplied to the motor 2 through the cable/hose 7. When the valve 11, which may be a butterfly valve, and which may close to fluid flow through the pump, is opened, for example in that the current for the motor 2 is also connected to the valve 11, and the motor 2 is started, fluid will enter through the annular gap 12 which is formed between the well pipe 10 and the motor 2, through the suction screen/inlet 3 and further to not shown pump stages in the pump housing 4. From the pump housing 4 the fluid exits through the outlet 5 into the well pipe 10 on the pressure side of the pump 1 and further through the well pipe 10. The fluid on the pressure side of the pump 1 is prevented from returning between the pipe 10 and the pump 1 by the seal 8.

A device according to the invention remedies the main drawbacks of conventional equipment in that it eliminates the need both for a separate drive plug to be used to position the pump, and for a separate pressure pipe to be used for the transport of the fluid out of the well pipe.

What is claimed is:

1. A well pump device for use in connection with the recovery of hydrocarbons comprising:

a pump device including a fluid inlet and a fluid outlet, wherein the pump device is adapted to intake fluid through the fluid inlet and to output fluid through the fluid outlet;

a seal assembly adapted to interface with an interior surface of a well pipe to from a seal between the well pipe and the seal assembly such that the pump device may move through the well pipe while the seal assembly interfaces with the interior surface of the well pipe, wherein the fluid inlet is located on a first side of the seal assembly and the fluid outlet is located on a second side of the seal assembly; and a valve that alternately:

places the fluid inlet in fluid communication with the fluid outlet; and removes the fluid inlet from fluid communication with the fluid outlet to enable the formation of a pressure difference between the sides of the seal assembly; wherein the well pump device is adapted to be moved through the well pipe by the pressure difference when the valve has removed the fluid inlet from fluid communication with the fluid outlet and adapted to pump fluid from the fluid inlet out the fluid outlet when the valve has placed the fluid inlet in fluid communication with the fluid outlet.

2. A well pump device according to claim 1, further comprising centralizing devices adapted to keep the pump device centered in the well.

3. A well pump device according to claim 1, wherein the valve is a butterfly valve.

4. The well pump device of claim 1, wherein the well pump device is further adapted to pump fluid through the outlet to be in direct contact with the well pipe when the valve places the fluid inlet in fluid communication with the fluid outlet.

5. A combination well pump/well drive plug device for use in connection with the recovery of hydrocarbons comprising:

a pump device including a fluid inlet and a fluid outlet, wherein the pump device is adapted to intake fluid through the fluid inlet and to output fluid through the fluid outlet; and a fluid seal assembly adapted to permit the establishment of a pressure differential when the well pump/well drive plug device is in a well pipe and to permit movement of the well pump/well drive plug device in the pipe due to the pressure differential; wherein the well pump/well drive plug device is adapted to operate as a well pump when a valve in fluid communication with the fluid inlet and fluid outlet is open to move fluid from the inlet through the outlet and adapted to operate as a well drive plug device when the valve is closed to enable the formation of the pressure differential so that the well pump/well drive plug device may be moved by the pressure differential.

6. The well pump/well drive plug device of claim 5, wherein the pump device is adapted to output fluid to be in direct contact with an interior of the well pipe through which the well pump/well drive plug device moves.

7. The well pump/well drive plug device of claim 5, wherein the fluid inlet is located on a first side of the fluid seal assembly and the fluid outlet is located on a second side of the fluid seal assembly.

8. A combination well pump/well drive plug device for use in connection with the recovery of hydrocarbons comprising:

a pump device including a fluid inlet and a fluid outlet, wherein the pump device is adapted to intake fluid through the fluid inlet and to output fluid through the fluid outlet; and wherein the combination well pump/well drive plug device is adapted to convert from a pumping mode to a well drive plug mode to move through a well pipe as a result of a pressure differential.

9. The combination well pump/well drive plug device of claim 8, further comprising a valve that, when open, permits the fluid inlet to be in fluid communication with the fluid outlet, wherein the combination well pump/well drive plug device is adapted to convert from a pump to a drive plug by the closure of the valve to move through a well pipe as a result of the pressure differential enabled by the closure of the valve.

10. A well, comprising:

a combination well pump/well drive plug device according to claim 9; and a well pipe; wherein the well is adapted to move fluid through the combination well pump/well drive plug device and transport the fluid in the direction of pumping so that the fluid comes into direct contact with the well pipe.

11. A well, comprising:

a combination well pump/well drive plug device according to claim 8; and a well pipe; wherein the well is adapted to move fluid through the combination well pump/well drive plug device and transport the fluid in the direction of pumping so that the fluid comes into direct contact with the well pipe.

12. A well, comprising:

a combination well pump/well drive plug device according to claim 8, wherein the combination well pump/well drive plug device does not have a separate pressure pipe.

13. A method of pumping fluid comprising the following actions:

(a) placing a combination well pump/well drive plug device according to claim 8 in a well pipe;

(b) converting the combination well pump/well drive plug device to a well drive plug, wherein action (b) may be performed before or after action (a);

forming a pressure difference between a first side and a second side of the combination well pump/well drive plug device and moving the combination well pump/well drive plug device through the well pipe by the pressure difference; and relieving the pressure difference between the first side and the second side of the combination well pump/well drive plug device; and pumping fluid from the first side to the second side.

14. A method of placing a pump in a well pipe comprising:

placing a combination well pump/well drive plug device into a well pipe, wherein the combination well pump/well drive plug device includes a fluid inlet and a fluid outlet, wherein the combination well pump/well drive plug device is adapted to intake fluid through the fluid inlet and to output fluid through the fluid outlet when the fluid inlet is in fluid communication with the fluid outlet;

transporting the combination wellpump/well drive plug device to a location in the well pipe away from the location where the combination well pump/well drive plug device was placed into the well pipe utilizing a pressure difference between one side of a seal on the combination well pump/well drive plug device and another side of the seal on the combination well pump/well drive plug device, the pressure difference being enabled by taking the fluid inlet out of fluid communication with the fluid outlet; and opening the valve and pumping fluid from the fluid inlet out the fluid outlet.

15. A method according to claim 14, further comprising using centralizing devices to keep the pump centered in the well.

16. A method according to claim 14, wherein the location is determined by a previously installed stop in the pipe or by a line attached to the well pump/well drive plug device.

17. The method of claim 14, further comprising pumping the fluid through the outlet so that the fluid comes into direct contact with the well pipe.

18. The method of claim 17, further comprising pumping the fluid towards a surface of the well without the use of a separate pressure pipe.

19. A method of pumping fluid comprising:

forming a pressure difference between a first side and a second side of a well pump device, the first side including a fluid inlet and the second side including a fluid outlet; wherein the well pump device is adapted to pump fluid from the fluid inlet through the fluid outlet;

transporting the well pump through a well pipe due to the pressure difference;

removing the pressure difference about the well pump device; and pumping fluid from the fluid inlet through the fluid outlet.

20. The method of claim 19, further comprising pumping the fluid through the outlet so that the fluid comes into direct contact with the well pipe.

21. The method of claim 19, wherein the pressure difference is formed by taking the fluid inlet out of fluid communication with the fluid outlet.

* * * * *

UNITED STATES PATENT AND TRADEMARK OFFICE

CERTIFICATE OF CORRECTION

PATENT NO. : 6,857,472 B2
DATED : February 22, 2005
INVENTOR(S) : Roger Stave

It is certified that error appears in the above-identified patent and that said Letters Patent is hereby corrected as shown below:

Title page,
Item [73], Assignee, change "ADR Subsea AS" to -- AGR Subsea AS --

Signed and Sealed this

Seventh Day of June, 2005

JON W. DUDAS
*Director of the United States Patent and Trademark Office*